US007111485B1

(12) United States Patent
Fiore

(10) Patent No.: US 7,111,485 B1
(45) Date of Patent: Sep. 26, 2006

(54) FLASHING BENDER

(76) Inventor: Paul J. Fiore, 377 County Rd., Hanson, MA (US) 02341-1614

( * ) Notice: Subject to any disclaimer, the term of this patent is extended or adjusted under 35 U.S.C. 154(b) by 0 days.

(21) Appl. No.: 10/896,107

(22) Filed: Jul. 21, 2004

(51) Int. Cl.
*B21C 3/02* (2006.01)

(52) U.S. Cl. ..... 72/176; 72/274; 72/468

(58) Field of Classification Search ..... 72/176, 72/274, 278, 291, 467, 468, 476, 477
See application file for complete search history.

(56) References Cited

U.S. PATENT DOCUMENTS 66,248 A * 7/1867 Kane ..... 72/176
414,090 A * 10/1889 Taylor ..... 72/468
2,166,347 A * 7/1939 Farney ..... 72/458
2,400,698 A 5/1946 Lissa
2,716,805 A * 9/1955 Reed ..... 72/256
2,986,193 A * 5/1961 Howell ..... 52/745.05
3,602,024 A * 8/1971 Sabroff et al. ..... 72/60
4,148,205 A 4/1979 Boysen
4,643,016 A 2/1987 Barberine et al.
5,515,706 A 5/1996 Paul
5,913,779 A 6/1999 Edvardsen
5,913,929 A 6/1999 Gustafsson et al.
5,943,899 A 8/1999 Jung
6,176,064 B1 * 1/2001 Janelle ..... 52/749.1

* cited by examiner

*Primary Examiner*—Daniel C. Crane
(74) *Attorney, Agent, or Firm*—John P. McGonagle

(57) ABSTRACT

A stencil-like plate with angled shapes cut through the plate surface. The plate is adapted to having a piece of flashing inserted perpendicularly into one of the angled shapes and pulled through the plate. A resulting elongated bend angle is formed in the pliable flashing strip.

8 Claims, 3 Drawing Sheets

FLASHING BENDER

BACKGROUND OF THE INVENTION

This invention relates to sheet metal flashing, and in particular, to a tool for forming longitudinal angles in elongated flashing strips.

In the building trades sheet metal flashing is used to cover and protect certain joints and angles, as where a roof comes in contact with a wall, chimney, roof window, or the like, especially against leakage. To accommodate these tasks, flashing usually comes in elongated rolls of very thin metallic material. Flashing is typically made from tin, aluminum, copper, steel, zinc, and the like. Before being applied to a joint, a length of flashing is cut to a desired length, depending upon the length of the joint to be covered. The flashing is then longitudinally bent to an angle desired to accommodate the angle bend of joint to be flashed.

Since various lengths of flashing with various longitudinal bend angles are needed at a job site, it is typical to cut and form the flashing on site. Builders will usually jury-rig a wooden frame for forming the elongated bend angle needed for the flashing. This results in a flashing which only approximates the angle needed to cover a particular joint and often is not accurate enough to prevent leaks.

SUMMARY OF THE INVENTION

The present invention addresses the problem of accurate formation of elongated flashing bends by providing a stencil-like plate with angled shapes cut through the plate surface. The plate is adapted to having a piece of flashing inserted perpendicularly into one of the angled shapes and pulled through the plate. Since flashing materials are pliable, a resulting elongated bend angle is formed in the flashing strip.

This together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF INVENTION

Figure 1:
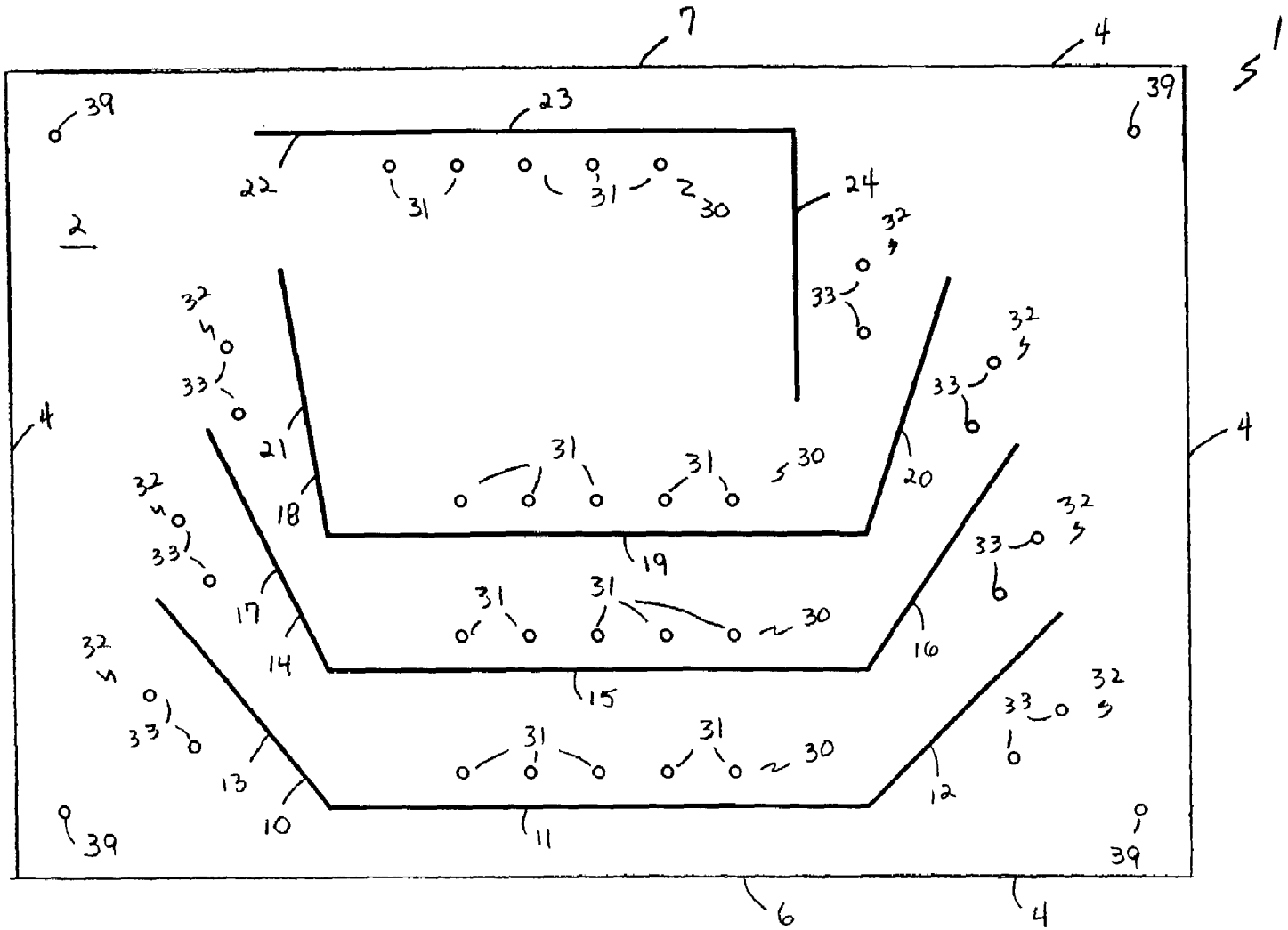
FIG. 1 is a front elevational view of the invention.
Figure 2:
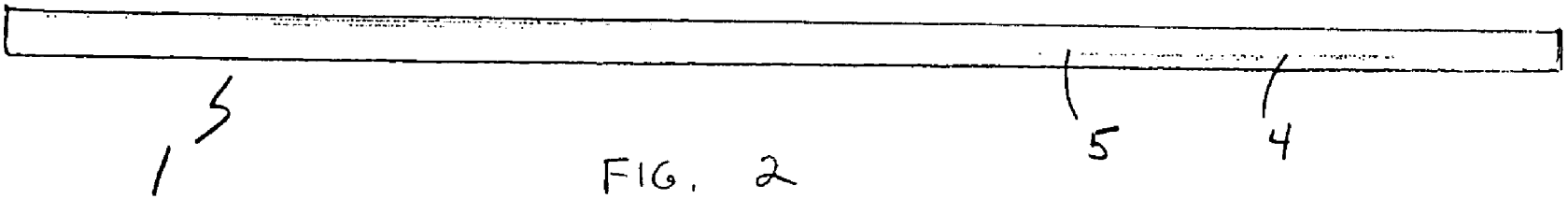
FIG. 2 is side elevational view of the invention.

Referring to the drawings in detail wherein like elements are indicated by like numerals, there is shown a flashing bender 1 constructed according to the principles of the present invention. The bender 1 is constructed from a hard, rugged, wear-resistant material, such as metal. Some of today's plastics could also be used. The bender 1 typically has a flat, rectangular, plate-like shape with a front surface 2, opposing parallel back surface 3, and four side edges 4 defining a bender body 5. In this embodiment of the invention four stencil bevelled channels 10, 14, 18, 22 are formed in the bender 1, each stencil channel being formed in the front surface 2 and extending through the bender body 5 and opening onto the back surface 3. In other embodiments of the invention more or less stencil channels may be formed. Shapes other than the rectangular shape of the present embodiment could also be used.

Each stencil channel 10, 14, 18, 22 has a straight elongated central portion and one or more continuous, attached, straight end portions, each said attached end portion forming an obtuse angle with an attached central portion. However, at least one end portion forms a 90° angle with an attached central portion.

Referring more specifically to FIG. 1, there are shown four stencil channels, further defined as the first 10, second 14, third 18, and fourth 22 channel, respectively. The first channel 10 is positioned closest to a side edge 4 hereinafter defined as the bender bottom side edge 6. The first channel 10 has a straight, elongated central portion 11 near to and parallel to the bottom side edge 6. The first channel central portion 11 terminates at one end in a straight, elongated, right end portion 12 and at the other end in a straight, elongated, left end portion 13. Both end portions 12, 13 form obtuse angles with the central portion 11 moving from the central 11 portion away from the bender bottom side edge 6. In this embodiment of the invention, the first channel right end 12 forms a 135° angle with the first channel central portion 11. The first channel left end 13 forms a 130° angle with the first channel central portion 11.

The second channel 14 is positioned next to and above the first channel 10. The second channel 14 has a straight, elongated central portion 15 near to and parallel to the first channel central portion 11. The second channel central portion 15 terminates at one end in a straight, elongated, right end portion 16 and at the other end in a straight, elongated, left end portion 17. Both end portions 16, 17 form obtuse angles with the central portion 15 moving from the central portion 15 away from the bender bottom side edge 6. In this embodiment of the invention, the second channel right end 16 forms a 125° angle with the second channel central portion 15. The second channel left end 17 forms a 120° angle with the second channel central portion 15.

The third channel 18 is positioned next to and above the second channel 14. The third channel 18 has a straight, elongated central portion 19 near to and parallel to the second channel central portion 15. The third channel central portion 19 terminates at one end in a straight, elongated, right end portion 20 and at the other end in a straight, elongated, left end portion 21. Both end portions 20, 21 form obtuse angles with the central portion 19 moving from the central portion 19 away from the bender bottom side edge 6. In this embodiment of the invention, the third channel right end 20 forms a 110° angle with the third channel central portion 19. The third channel left end 21 forms a 100° angle with the third channel central portion 19.

The fourth channel 22 is positioned next to and above the third channel 18, close to a side edge 4 hereinafter defined as the bender top side edge 7. The fourth channel 22 has a straight, elongated central portion 23 near to and parallel to the third channel central portion 19 and near to and parallel to the bender top edge 7. The fourth channel central portion 23 terminates at one end in a straight, elongated, right end portion 24. In this embodiment of the invention, the fourth channel right end 24 forms a 90° angle with the fourth channel central portion 23 moving from the central portion 23 away from the bender top side edge 7.

Above the central portions 11, 15, 19 of the first 10, second 14 and third 18 channels, respectively, a line 30 of five holes 31 each are formed, each said line 30 being near to, parallel and above the respective, adjacent channel central portion. Each hole 31 is formed in the front surface 2, extending through the bender body 5 and opening onto the back surface 3. A line 30 of five holes 31 is formed near to, parallel and below the fourth channel central portion 23. A line 32 of two holes 33 is formed near to, parallel and outside the end portions 12, 13, 16, 17, 20, 21, 24 of each channel 10, 14, 18, 22, said lines 32 being formed near to the end portion ends furthest away from their respective central portions 11, 15, 19, 23. Each hole 33 is formed in the front surface 2, extending through the bender body 5 and opening onto the back surface 3. The holes 31, 33 are adapted to receiving a stop element 35 which adjusts the length and portion of a particular channel. The stop element 35 has a connected portion 36 which fits into an adjacent portion of a channel. The positioned stop element connected portion 36 prevents a strip 40 of flashing from sliding past the stop element connected portion 36 as the strip 40 is pulled through the bender 1.

In addition to the stop element holes 31, 33 each corner of the bender surface has a single hole 39. Each hole 39 is formed in the front surface 2, extending through the bender body 5 and opening onto the back surface 3. These holes 39 are adapted to receiving a fastener for attaching the bender 1 to a frame or other apparatus while the bender is in operation.

Figure 3:
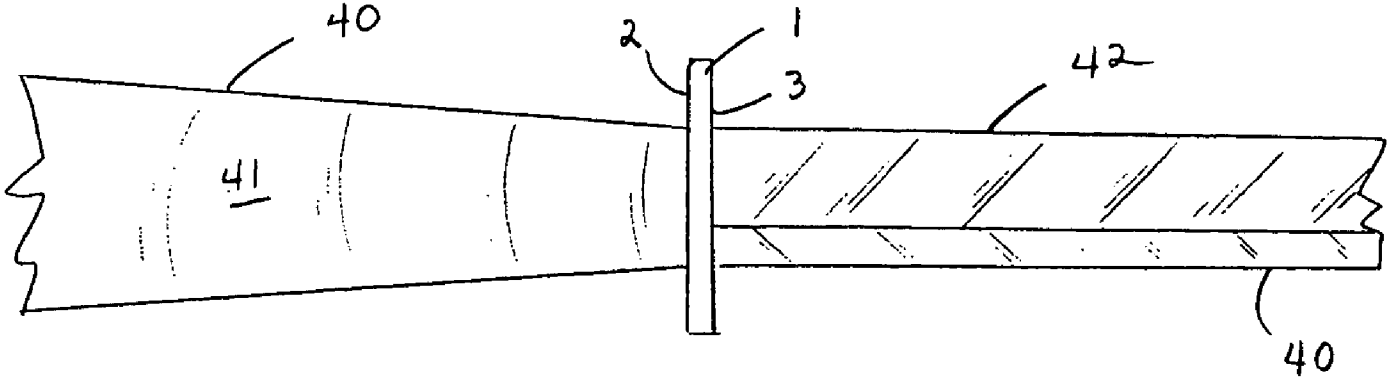
FIG. 3 is a side view of the invention with a portion of a strip of flashing being pulled through the invention.
Figure 4:
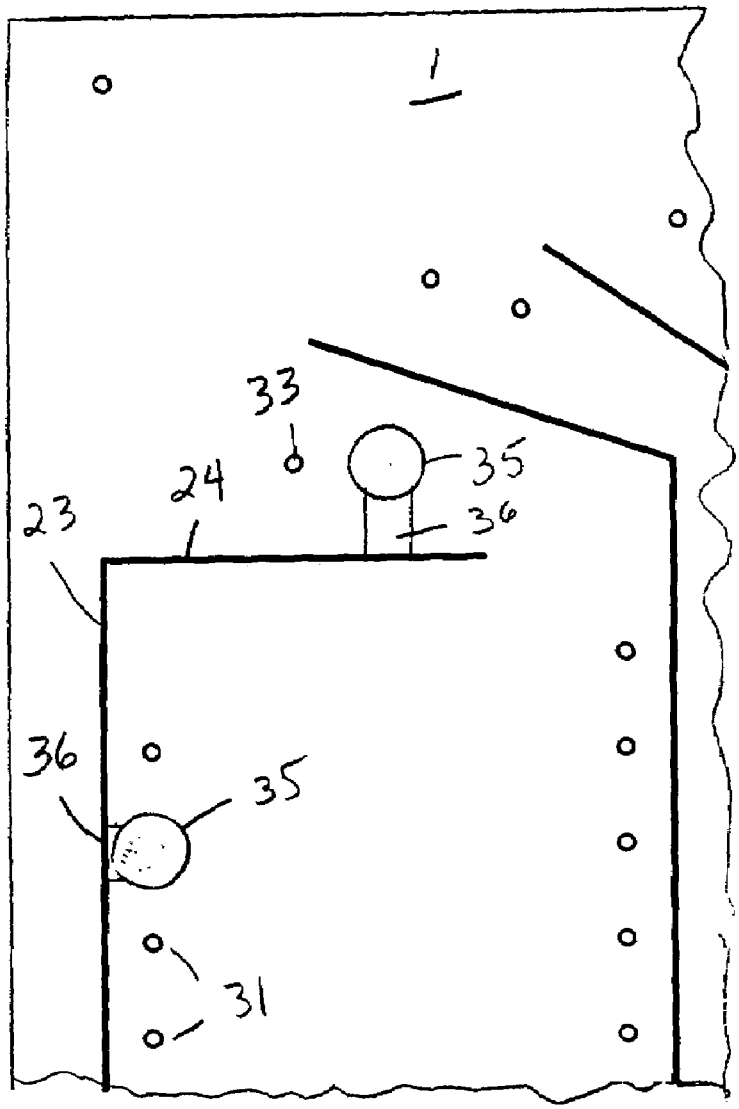
FIG. 4 is a front view of a fragment of the invention with stop elements added.
Figure 5:
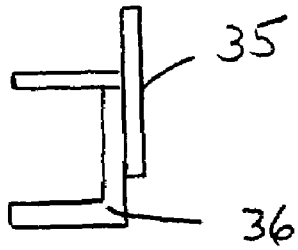
FIG. 5 is a side view of a stop element.

In operation, a flashing strip 40 of predetermined width is cut to a desired length. The desired angle of bend is determined and the appropriate channel and end portion is selected. Stop elements 35 are installed in the appropriate holes 31, 33 corresponding to the flashing strip width and angle of bend desired. The front end of the flashing strip 40 is positioned perpendicularly to the front bender surface 2. The flashing strip leading edge is then inserted into a desired channel and drawn through the bender body 5 out through the bender back surface 3. FIG. 3 illustrates a flashing strip 40 being drawn through the bender with reference number 41 designating the pre-bent portion of the flashing strip and 42 designating the flashing strip after bending.

It is understood that the above-described embodiment is merely illustrative of the application. Other embodiments may be readily devised by those skilled in the art which will embody the principles of the invention and fall within the spirit and scope thereof.

I claim:

1. A tool for forming longitudinal angles in elongated flashing strips, comprising:

a generally rectangular plate having two opposing flat surfaces, said opposing surfaces being comprised of a front surface and opposing parallel back surface, said plate having four side edges, said opposing surfaces and side edges defining a plate body;

a plurality of angled channels formed in said plate body each said angled channel being formed in the front surface and extending through the plate body onto the back surface, each said angled channel having a straight elongated central portion central with two opposite ends;

wherein said plurality of channels includes:

a first channel positioned near to a side edge defined as a bottom side edge, said first channel having a straight, elongated central portion near to and parallel to the bottom side edge, said first channel central portion terminating at a first end in a straight, elongated, right end portion and at a second end in a straight, elongated, left end portion, both said end portions forming obtuse angles with the central portion moving from the central portion away from the bottom side edge;

a second channel positioned near to and above the first channel, said second channel having a straight, elongated central portion near to and parallel to the first channel central portion, said second channel central portion terminating at a first end in a straight, elongated, right end portion and at a second end in a straight, elongated, left end portion, both said end portions forming obtuse angles with the central portion moving from the central portion away from the bender bottom side edge;

a third channel positioned near to and above the second channel, said third channel having a straight, elongated central portion near to and parallel to the second channel central portion, said third channel central portion terminating at a first end in a straight, elongated, right end portion and at a second end in a straight, elongated, left end portion, both said end portions forming obtuse angles with the central portion moving from the central portion away from the bender bottom side edge;

a fourth channel positioned near to and above the third channel, close to a side edge defined as a top side edge, said fourth channel having a straight, elongated central portion near to and parallel to the third channel central portion and near to and parallel to the top side edge, said fourth channel central portion terminating at one end in a straight, elongated, right end portion, a plurality of holes in a plurality of lines adjacent each channel central portion and end portion, each said hole formed in the front surface and extending through the plate body and opening onto the back surface;

a plurality of stop elements, each stop element adapted to fit into a hole and having a connected portion which fits into an adjacent portion of a channel.

2. A tool as recited in claim 1, further comprising:

a plurality of fastening holes, each hole positioned adjacent to a corner of the plate body, each said fastening hole formed in the front surface, extending through the bender body and opening onto the back surface, said fastening holes adapted to receive a fastener for attaching the plate body to a frame.

3. A tool as recited in claim 2, wherein:

said plate body is constructed from a hard, rugged, wear-resistant material.

4. A tool as recited in claim 1, wherein said plurality of holes in lines are comprised of:

a line of five holes positioned above the central portions of the first, second and third channels, respectively, each said line being near to, parallel and above the respective, adjacent channel central portion;

a line of five holes positioned near to, parallel and below the fourth channel central portion;

a line of two holes positioned near to, parallel and outside the end portions of each channel, said lines of two holes being formed near to the end portion ends furthest away from their respective central portions.

5. A tool as recited in claim 4, wherein:

the first channel right end portion forms a 135° angle with the first channel central portion and the first channel left end portion forms a 130° angle with the first channel central portion.

6. A tool as recited in claim 5, wherein:

the second channel right end portion forms a 125° angle with the second channel central portion and the second channel left end portion forms a 120° angle with the second channel central portion.

7. A tool as recited in claim 6, wherein:

the third channel right end portion forms a 110° angle with the third channel central portion and the third channel left end portion forms a 100° angle with the third channel central portion.

8. A tool as recited in claim 7, wherein:

the fourth channel right end portion forms a 90° angle with the fourth channel central portion moving from the central portion away from the top side edge.

* * * * *